US012624546B2

(12) United States Patent
Busatta et al.

(10) Patent No.: US 12,624,546 B2
(45) Date of Patent: May 12, 2026

(54) INSULATING PANEL FOR CONSTRUCTION WITH GRAB SURFACE

(71) Applicant: TEMA TECHNOLOGIES AND MATERIALS SRL, Vittorio Veneto (IT)

(72) Inventors: Nicola Busatta, Conegliano (IT); Federico Cais, San Vendemiano (IT)

( * ) Notice: Subject to any disclaimer, the term of this patent is extended or adjusted under 35 U.S.C. 154(b) by 256 days.

(21) Appl. No.: 18/556,561

(22) PCT Filed: Apr. 14, 2022

(86) PCT No.: PCT/IB2022/053512
§ 371 (c)(1),
(2) Date: Oct. 20, 2023

(87) PCT Pub. No.: WO2022/224097
PCT Pub. Date: Oct. 27, 2022

(65) Prior Publication Data

US 2024/0191498 A1 Jun. 13, 2024

(30) Foreign Application Priority Data

Apr. 21, 2021 (IT) ..... 102021000010031

(51) Int. Cl.
*E04B 1/78* (2006.01)
*E04B 1/80* (2006.01)
(Continued)

(52) U.S. Cl.
CPC ..... *E04B 1/80* (2013.01); *E04C 2/243* (2013.01); *E04B 2001/742* (2013.01); *E04C 2002/002* (2013.01)

(58) Field of Classification Search
CPC ... E04B 1/78; E04B 1/80; E04B 1/803; E04B 2001/742; E04B 1/76; E04C 2/24;
(Continued)

(56) References Cited

U.S. PATENT DOCUMENTS 6,715,249 B2 4/2004 Rusek et al.
8,474,208 B2 * 7/2013 Ruland ..... B32B 7/022 428/326
(Continued)

FOREIGN PATENT DOCUMENTS

GB 2577648 A 4/2020
WO 1996033866 A1 10/1996
WO 2004022335 A1 3/2004

OTHER PUBLICATIONS

International Search Report for corresponding PCT/IB2022/053512 dated Jul. 12, 2022.
(Continued)

*Primary Examiner* — Chi Q Nguyen
(74) *Attorney, Agent, or Firm* — Egbert, McDaniel & Swartz, PLLC

(57) ABSTRACT

An insulating panel for use in construction has a central layer, a first water-resistant coating and a second water-resistant coating on opposite sides of the central layer. The first coating and the second coating are joined to the central layer with a glue layer or a thermo-adhesive material. Each of first coating and the second coating is a plastic sheet that is scratched or abraded.

18 Claims, 3 Drawing Sheets

(51) Int. Cl.
*E04C 2/24* (2006.01)
*E04B 1/74* (2006.01)
*E04C 2/00* (2006.01)

(58) Field of Classification Search
CPC ..... E04C 2/243; E04C 2/284; E04C 2/296; E04C 2002/002
See application file for complete search history.

(56) References Cited

U.S. PATENT DOCUMENTS 8,703,632 B2 4/2014 Schlueter
9,909,317 B2 * 3/2018 Johnson ..... E04D 3/18
10,160,187 B2 * 12/2018 Unvericht ..... B32B 27/20
11,459,767 B1 * 10/2022 Riley ..... E04B 1/7629
2008/0086982 A1 * 4/2008 Parenteau ..... E04C 2/365 52/794.1
2008/0174147 A1 * 7/2008 Skaradzinski ..... B62D 33/048 296/181.3
2011/0217516 A1 9/2011 Wedi
2011/0225918 A1 9/2011 Wedi
2013/0318911 A1 * 12/2013 Sealock ..... E04C 2/243 428/71
2013/0326982 A1 * 12/2013 Jordan ..... E04C 2/288 52/426
2015/0140269 A1 5/2015 Bahnmiller
2021/0095469 A1 * 4/2021 Overman ..... B32B 5/18
2021/0379876 A1 * 12/2021 Boss ..... B32B 27/308
2023/0235569 A1 * 7/2023 Kandrashou ..... E04F 13/0866 52/481.2
2025/0217442 A1 * 7/2025 Zhang ..... G06F 16/24573

OTHER PUBLICATIONS

Written Opinion of the International Searching Authority for corresponding PCT/IB2022/053512 dated Jul. 12, 2022.
International Preliminary Report on Patentabiity for corresponding PCT/IB2022/053512 dated Jul. 12, 2022.

* cited by examiner

INSULATING PANEL FOR CONSTRUCTION WITH GRAB SURFACE

The present invention relates to an insulating panel for construction of the multi-layer type, with grab surface.

FIELD OF APPLICATION

The invention is specifically intended for the building industry and particularly in the field of semi-finished components for construction such as, by way of non-limiting example, insulating panels and/or infill panels. More in detail, an insulating panel is proposed of expanded and/or extruded polystyrene or of an expanded polyurethane, which has particular surface layers for coating and protection, which are symmetrically coupled on both faces making the panel rigid and self-supporting, damp-resistant and provided with an improved adhesion to glues and/or to cement mortars. Therefore, the panel disclosed in the invention is usable as a thin and lightweight constructive element which insulates and waterproofs, and also supports the direct gluing of tiles in damp environments, such as for example in the case of bathrooms, saunas, laundry rooms or kitchens. By way of example only, it is suitable for making walls, infill walls, floors, floorings, or spaces for insertion of bathtubs and showers, or seats or niches integrated in the walls of modern bathrooms coated with ceramic tiles.

Generally, in the field of constructive products panels for thermal insulation, otherwise called non-conductive or insulating panels, are widely known and widespread, which are made up of an inexpensive rigid material, having an extremely low weight but a highly non-conductive performance such as expanded polystyrene or extruded polystyrene, otherwise called by the acronyms EPS and XPS. Generally, said EPS or XPS panels are single-layer panels, having a thickness between 2 and 20 cm, and their opposite main faces are smooth and parallel one another, having constant thickness. Some solutions provide the outer main faces coated with a protective film of different materials, such as for example a paper sheet or a plastic plate or non-woven fabric.

It has been further found that said expanded EPS or expanded-extruded XPS polystyrene is extremely advantageous for various aspects: for performance, productive, economical, and recyclability aspects. However, it has some problems when it is used as material for construction panels, according to the specific aims of the present invention. A first problem concerns its poor resistance when used with structural functions, such as a constructive element of walls, partitions, infill walls or as support for ceramic coatings, plasters, or any surface finishing for environments. In fact, a conventional EPS or XPS panel has a low resistance to bending and to damp and has a surface which is not suitable for the grab of glues or cement mortars commonly used. It has been also found that its surface tends to crumble or crash when accidentally under bending stress in construction sites, or during transport. A further problem concerns its limited resistance to fire and high temperatures. Despite being treated with flame retardants, when subject to high temperatures a similar manufacture sublimates and loses its structural integrity.

Generally, in order to overcome such disadvantages, in conventional and known solutions, said EPS or XPS panels are covered with the cited protective films, such as a paper sheet or a plastic plate or non-woven fabric. Additional layers are also known, which are fire resistant, non-flammable or in any case suitable for retarding combustion. By way of example only, in the vertical walls of buildings such protective layers are made of plasterboard, fiber cement, magnesium oxide, wood cement or made with a layer of rock or glass wool so as to completely coat the panel or at least its side edges, since they are the preferred combustion priming zone. Protective sheets made of metal or cement are also known, which are applied on the outer surface of the panel. However, it is known that manufactures made with such added layers have a high thickness, a remarkable specific weight, processing and cutting difficulties, hygroscopicity, poor dimensional stability, low tensile strength, and high costs.

Recently, companies operating in the construction sector have provided to improve said insulating panels in expanded or extruded polystyrene by means of new additive chemical compounds, or of innovative external protective layers, so as to further increase the thermal insulation characteristics or to reduce the thickness and also, in particular, to improve the fire reaction, so as to exceed the latest provisions. By way of example only, expanded polystyrene comprising graphite particles is known, which is suitable for offering a reduced thermal conductivity, limiting the thickness provided for insulation, and is also suitable for absorbing and reflecting infrared rays, such as the material marketed under the name Neopor® of the German company Basf SE, Ludwigshafen—www.basf.com, having a thermal conductivity equal to 0.031 W/mK and a density equal to 18 kg/m$^3$. Furthermore, the use of a particular type of graphite is also known, which is called expandable graphite, which increases its volume at high temperatures, creating a protection barrier against fire: it is sometimes added in varnishes or adhesives.

Alternatively to said XPS and EPS polystyrene, other foam materials are known and widespread, which are suitable for making panels and offer a good insulation capacity but are sometimes disadvantageous due to mechanical characteristics and/or of resistance to bending or damp and/or long-term durability and/or for production reasons. By way of example only, it is reminded that expanded polyurethane offers a good insulation capacity, but it has to be adequately protected: moreover, in the production phase it requires a higher quantity of primary energy than said polystyrene and is not easily recyclable. However, said expanded polyurethane is a suitable material for the panel proposed by the present invention since it is particularly coated.

More in detail regarding the specific field of application of the proposed solution, in the sector of interior architecture there is a need for new materials and/or constructive elements suitable for rapidly making walls and subfloors with reduced costs and weights compared to traditional materials such as bricks made of clay or cement, or with respect to the reinforced concrete works, or also compared to the conventional plasterboard panels. Particularly, professionals require versatile and lightweight constructive elements, shaped like rigid and thin panels, and provided with a high resistance to bending and damp: moreover, panels are required which are able to ensure a good adhesion to glues and cement mortars. Essentially, there is a need of a self-supporting panel, which is easy to transport and to cut in the construction site by a single person according to need, this panel being rigid and suitable for supporting the laying of tiles, also in the presence of water and/or damp.

Particularly, new solutions of self-supporting and waterproofing panels are needed, which allow to make, in an easier and more inexpensive way compared to said bricks and also in a safer and more durable way compared to conventional plasterboard, any configuration of wall, niche, shaped space, floor or subfloor located in damp environments and coated with tiles, as in the case of bathrooms, saunas, laundry rooms and kitchens. By way of example only, it should be taken into consideration the frequent need to obtain spaces for the insertion of bathtubs and showers in bathrooms, or niches integrated in the walls, where said spaces and niches are made in the construction site according to a design provided by the designer, in line with the side walls and coated with the same tiles. Together with said requirements, there is a need for an insulating panel for damp environments which can be directly coated with tiles.

Among the most widespread and advantageous known solutions there are multifunctional insulating panels made up of a foamed core in a lightweight insulating material, such as expanded polystyrene or expanded polyurethane, with a waterproofing and hardening multi-layer coating which is symmetrically glued to both faces, like a sandwich panel. Generally, such superficial coating is made up of various layers having different mutually combined functions, so as to obtain an insulating panel which is resistant to damp and bending, and it is usable as a constructive element to make up infill walls, niches or floors, also in damp environments such as bathrooms and saunas. Particularly, some panels provide a further external layer which improves the grab of glues or cement mortars, so as to support the gluing of tiles or plasters directly laid on the panel surface.

Therefore, it has been found that in this advanced type of insulating panels said multi-layer coating consists on the whole of at least three layers, with a waterproof layer such as a plastic plate or a waterproof paper, which is coupled to different permeable layers placed over and/or under it, so as to facilitate the gluing and also to increase the structural rigidity, such as for example a non-woven fabric in plastic fibers and/or a net. By way of example only, it is reminded that the multi-layer panel named Kerdi Board by the German company Schluter-Systems KG, D-58640 Iserlohn www.schlueter.de, is suitable for making bathrooms and shower spaces. Currently, this type of insulating panels with structural and waterproofing functions for damp environments is widely used and appreciated as it considerably facilitates the work in the construction site compared to traditional materials, such as clay bricks or plasterboard sheets.

It has been further found that in the interior architecture rigid sheets made of plasterboard or of other cement-based materials are widely used, which are possibly coupled to other layers according to needs. Such sheets have good structural characteristics and a smooth surface, ready to be coated with tiles or plasters. However, they are not suitable for the aim of the invention being disadvantageous during transport and working in the construction site, due to their heavy weight and the dust released during the cutting phase. Moreover, they are not very suitable for installations where there is a high presence of water and/or vapor, such as in bathrooms and saunas.

Alternatively, for laying tiles in damp environments insulating panels having a good compatibility with cement glue for tiles are also known and ensure a greater resistance to tearing compared to the above-mentioned multi-layer insulating panels. These panels have a lightweight core made of a foamed plastic material, and provided with a multi-layer and composite coating, generally glass fiber-based, which externally comprises a thin mineral and/or cement layer facilitating the application of a finishing and/or the laying of tiles. However, they have some disadvantages, such as the known problem of cement dust release during the cutting phase in the construction site, in addition to a high production complexity.

Essentially, in the construction sector an innovative insulating and waterproofing panel for damp environments is required, which can be produced at low costs and with high production volumes, is lightweight and resistant, usable as an easily and safely workable constructive element, and provided with an outer surface allowing the grab of a common cement mortar for tiles, and with high resistance to tearing. Moreover, such a panel is also required to be resistant to high temperatures.

STATE OF THE ART

In order to determine the state of the art related to the proposed solution, a conventional verification has been carried out, examining public archives, which has led to the identification of the prior art cited below:

D1: U.S. Pat. No. 8,703,632 (Shlueter)
D2: U.S. Pat. No. 6,715,249B2 (Rusek et al.)
D3: WO2004022335 (Taylor et al.)
D4: WO9633866 (Atevic)
D5: US2011217516 (Wedi)
D6: US2011225918 (Wedi)

D1 proposes a waterproofing and hardening sandwich panel with an insulating core in a damp-resistant material such as closed-cell foamed polystyrene, on which a first water-resistant layer is glued such as a sheet of waterproof paper or a non-extendable synthetic plate, where a permeable layer such as a fabric, a non-woven fabric or a mesh is glued to the external part, and also provided with a large-mesh net interposed and glued between said paper and said fabric. These three layers glued on both faces harden the structure of the panel and prevent it from deformation once mounted: particularly, the external permeable layers allow the mortar for tiles or plasters to penetrate and anchor.

D2 describes an insulating and protective panel for covering walls in construction, consisting of an insulating layer which is coupled on the internal side to a coating which makes it particularly rigid and resistant, being formed by a plurality of interwoven high-resistance fibers, for example carbon or mineral or polyamide or Kevlar fibers or fibers of other low-tensile materials, which are crossed together in an oriented way like a non-deformable mesh on the plane. Moreover, it is provided that the assembly adhesive can at least partially penetrate into the interstices between the fibers so as to firmly anchor the panel to a load-bearing structure. In a different embodiment, a hardening and protective polymeric coating is glued on the opposite side which also acts as barrier to vapor and damp, being made of a first polyethylene plate and a second polyester plate with an interposed hardening net which is also made of a plastic material.

D3 proposes a panel for construction consisting of a polystyrene layer coated with a net-like fabric and a small fiberglass mattress, wherein a cement compound saturates and connects the different layers together, so as to obtain a rigidity and resistance such as to support the fastening elements commonly used in construction, and also to support the laying of tiles directly glued on the outer surface by using commonly used adhesives.

D4 describes a laminated multi-layer structure with improved fire resistance characteristics, which provides a central layer made of an insulating material and protective layers for coating on both opposite faces like a sandwich panel: they include a fibrous reinforcement layer which is joined to an adhesive layer of inorganic type and an external layer of an organic resin, wherein said adhesive layer consists of water, magnesium sulphate or magnesium chloride, magnesium oxide and sodium silicate, while said resin is a gel-coat based on modified polyester resin with aluminum hydroxide.

D5 proposes an XPS panel for construction having a multi-layer coating where the first layer contacts the foamed core and consists of a two-component epoxy resin on which glass fiber is sprayed so as to form an intermediate layer of casually placed and flattened fibers, and with a top layer consisting of a two-component epoxy resin covered with sand sprayed during the hardening phase so as to form a siliceous surface which is ready for the finishing like a rigid layer of fiberglass coated with sand.

D6 describes a multi-layer panel suitable for supporting the laying of tiles, consisting of a central layer in a foam material, such as polystyrene XPS, which is provided with a rigid coating on at least one side, where said coating comprises at least three layers: an adhesive layer toward the central layer, a fiberglass non-woven layer and an external connecting layer made of a mortar based on chalk or cement, which is rigid so as to resist to compression and to have a smooth outer surface.

Drawbacks

A first problem, which is well-known to the operators of the sector is related to the resistance to tearing of an adhesive for laying tiles, which is sometimes insufficient when they are glued on the front face of an insulating and/or protective panel. More in technical detail, in the European construction sector the EN1348 regulation is known which establishes that the minimum value of resistance to tearing, also called pull-out, in a traction test perpendicular to the plane on a standardized packet screed-glue-tile must be at least equal to 0.5 N/mm$^2$: it corresponds to the value of the resistance to tearing of the adhesive, measured perpendicularly to the laying plane. All adhesives for tiles currently present on the market, both glues and mortars cement, thus comply with this standard. Consequently, by analogy this assessment method has been adopted also when in said packet an insulating panel is interposed, where the adhesion interface between the panel coating and the tile adhesive becomes the weak spot. Indeed, such adhesives are naturally compatible with cement and/or cement-based materials, such as subfloor screeds, but they are not compatible with the plastic materials generally used in the protective and/or waterproof layers of panels.

Experimentally it has been found that the biggest problems of adhesion in the known and conventional solutions are associated to the presence of a waterproof plate made of plastic, of impregnated paper or of metal, and particularly where said plate is smooth and does not allow an appropriate grab of the adhesive for tiles, or of the glue for coupling to the foamed core. Such problems are relevant in the case of vertical installations and in damp environments, such as in tiled walls of bathrooms and saunas. On the contrary, the problem of adhesion is less relevant in case of horizontal floors in damp-free environments.

In this regard, it has been experimentally found that for the most advanced solutions, comprising at least one waterproof layer as said plate, coupled to at least one permeable external layer made of a net or a non-woven fabric to facilitate the grab of the cement mortar, such as for example according to D1, it is hard to reach said limit value of 0.5 N/mm$^2$ according to the EN1348 regulation, since a breaking interface is created on the waterproof smooth layer. On the contrary, panels made of a core which is foamed and reinforced on both sides with a fiberglass fabric, which has been in turn impregnated and covered with a layer of cement mortar, such as for example according to D6 or D3, show a greater compatibility with cement glue, and reach said limit value of 0.5 N/mm$^2$ according to said EN 1348 regulation. However, these panels are not lightweight or easily workable as the above-mentioned panels with waterproof plate of plastic or paper, layers of non-woven fabric and/or nets, having the known problem of dust release during the cutting phase in the construction site, and with lower values in the tests of vapor permeability resistance.

Furthermore, in this type of panels having cement-based layers some productive difficulties can be found, which are even greater where a rigid supporting layer is provided in glass fiber or similar composites: moreover, they involve high costs. Where sprayed sand is also applied on the panel surface, such as for example according to D5, it is then believed that such a solution is not suitable for a modern automated continuous processing cycle where the coating, and/or the single layers it consists of, is provided in a rolled way for the purpose of an automatic coupling to the insulating layer. The protective layer according to D4 is also expensive and complex to produce: moreover, it does not meet all the aims of the present invention.

Sometimes an inadequate structural behavior has been found in the panels with foamed core and a protective and/or hardening coating which is applied on one side only, or on both sides but in an asymmetrical way, such as for example in D2. In particular, for the purposes of the invention, an insulating panel with asymmetrical stratification and one face covered by ceramic tiles, having a significant weight, can have an inadequate flexural and/or torsional resistance if used as a constructive element which is self-supporting, non-adherent and/or fixed in an integral way to a vertical load-bearing wall or a floor slab.

More specifically with regard to the adhesion on the outer surface of the panel in the construction of indoor environments with presence of water and/or vapor and/or damp, where floors and walls have to be rendered waterproof and coated with tiles and where it is also necessary to obtain spaces or niches in various shapes as generally in the case of bathrooms, shower spaces and saunas, an insulating waterproofing panel is not known and is required which is at the same time provided with a very lightweight and resistant structure, without cement-based materials, which does not release dusts during the cutting phase, which is easy to produce at low costs and is also able to overcome the known problem of the adhesion between the internal layers forming the panel, so as to ensure in any condition that the mentioned minimum value is reached of 0.5 N/mm$^2$ in the tear resistance test, or pull-out, according to said EN 1348 regulation.

More in technical detail about this test, reference is made to an assembly packet of the involved layers which consists of a cement base on whose top face the panel to be tested is glued, with a C2-class cement adhesive, on the top face of which panel a ceramic tile of small dimension is glued, with the same cement glue. Said packet is left at a constant temperature of 25° C. for 28 days and then a small metallic block with a threaded insert is connected to the tile, by means of a fast glue such as an epoxy glue. With a disk grinding wheel an incision around the tile is then made to isolate a testing area equal to 50 mm×50 mm in size. Once the epoxy glue reaches the maximum adhesion degree, a dynamometer is connected to said small metal plate and a tensile test orthogonally to the laying plane is performed, observing the tear strength which is measured in newtons N, and recording the peak value which is then divided by the area of the tile equal to 2500 $mm^2$. This value is also called resistance to tearing, it is measured in $N/mm^2$ and represents the index which allows to evaluate to what extent said packet is adhered.

Observing the breaking interface in the packet so tested, once the peak of the tensile strength is reached, allows to identify the weak element of the stratification. This observation is, therefore, particularly useful in the case of complex stratifications such as those of the multi-layer panels of this invention. For example, it has been found that very lightweight and resistant panels, without any cement layers and provided with at least one permeable layer for grab, for example of a non-woven fabric, and which are also provided with at least one waterproof plastic plate to have a high resistance to the passage of vapor, obtain insufficient results in said test of the resistance to tearing, equal to about 0.2 $N/mm^2$. The analysis of the tested packet has shown that the insertion of plastic elements, consisting of two or more layers, leads to significant advantages in the resistance to the passage of vapor, water impermeability or thermal insulation, but it considerably reduces the resistance to tearing of the whole packet. In particular, significant settlings are found in the adhesion interfaces between the plastic layers, for example between the foamed core and a plastic plate directly applied on it, or at the exterior where the cement adhesive for tiles is directly applied on said plastic plate.

Given the above, a new lightweight and resistant insulating panel is required in the construction sector, which is more advantageous compared to the cited solutions and suitable for solving the above-mentioned problems, with a high resistance to tearing and without any settling in the adhesion interfaces between layers. In particular, an insulating panel is not known, and it is desirable for bathrooms and saunas, provided with a high resistance to the passage of vapor, without any cement layer, and suitable for the laying of tiles directly glued on its outer surface with a resistance to tearing which is higher than said value of 0.5 $N/mm^2$.

SUMMARY OF THE INVENTION

This and other aims are achieved by the present invention according to the characteristics of the appended claims, solving the foregoing problems by means of a lightweight and self-supporting insulating panel (10) for construction with improved adhesion, which is usable as constructive and protective element of walls, infill walls, floors and subfloors in damp environments, such as bathrooms and saunas, being able to support the laying of tiles directly applied on it and with a high resistance to tearing. It is made up of a central layer (100) in a foamed insulating and a damp-resistant material, such as XPS or EPS polystyrene or expanded polyurethane, and of a particular coating (101, 102) with high resistance to the passage of vapor and without cement, which is joined to said central layer (100) on both outer faces forming a symmetrical sandwich structure, wherein at least the coating on the front side (102, 110) has the outer surface scratched (103) so as to optimize the grab to common glues or cement mortars for ceramic tiles.

Aims

In this way, through the considerable creative contribution whose effect constitutes an immediate technical progress, several advantages are achieved.

A first aim is to obtain an insulating panel for construction with improved adhesion, where the breaking interface in said tear or pull-out test is in correspondence with the layer of thermal insulating material, within the foamed material, and not in the adhesion interface between the layers or in the grab of the tiles on the outer surface such as it instead occurs in the known conventional solutions. In particular, in said tear test, a packet installed with the proposed insulating panel and with ceramic tiles directly glued on it, exceeds said minimum value of 0.5 $N/mm^2$ according to the EN1348 reference regulation, as described above.

A second aim of the invention is to provide a multi-layer insulating panel, which is extremely resistant, rigid and self-supporting, so as to be usable as a constructive element for building in an easy and inexpensive way the different structures and completion works which are currently needed in modern interior architecture, particularly in damp environments such as bathrooms and saunas. In particular, it is intended to obtain an insulating and waterproofing panel which has no cement layers and at the same time has a high resistance to the passage of vapor, a high resistance to tearing and is provided with an improved outer surface for adhesion purposes. Indeed, on such surface common ceramic coatings, or any finishing tile or plaster can be directly applied using known conventional glues or cement mortars, without the need to interpose films, nets, grab primers or any material to facilitate the adhesion.

A third aim, consequent to the previous aims, is to ensure a safest installation in damp environments where ceramic tiles are glued both on the horizontal plane and on the vertical plane, independently on their size and/or shape and/or weight, with a greater effectiveness, resistance and global duration compared to similar solutions of insulating panels of synthetic origin.

A fourth aim is to obtain an insulating panel for construction of the multi-layer type and without cement-based materials, which is very lightweight and easy to transport, to place and to work in the construction site by a single operator, using the common working tools, in the safest way and without releasing dust in the environment: it is therefore suitable for the installation in closed environments.

Moreover, a fifth aim is to make a multi-layer panel which is suitable for the laying of tiles and is provided with an optimized structural configuration. In particular, an outer surface with improved adhesion is proposed which allows to reduce the total number of layers forming the coating, with respect to the multi-layer solutions without cement, wherein a permeable layer is present on the external part to facilitate the grab of the mortar for tiles, such as for example a non-woven fabric, a mesh or a net, obtaining a remarkable reduction of total costs and an advantage in the production.

Therefore, yet another aim is to provide an insulating panel at a reasonable cost which can be industrially worked in an easy and inexpensive way with high production volumes. Consequently, the work in the construction site is remarkably facilitated and it is possible to considerably reduce time and costs for completing a construction manufacture.

Furthermore, an aim was to provide an insulating panel provided with all the characteristics described above, contextually considered, also with an advantageously improved fire resistance.

In short, it has thus been found that in the market of construction products there are several multi-layer and multifunctional insulating panels, which are lightweight and rigid, resistant to deformation and vapor, which are usable as constructive elements to rapidly build walls or subfloors for the laying of tiles in damp environments, such as bathrooms and saunas. However, insulating and protective panels are not available for damp environments where the coating of the foamed core is optimized according to the different aims of the invention. Therefore, the development is desirable and required of new solutions which are more effective and inexpensive, able to meet all the above mentioned contextually considered characteristics, with greater safety from the technical point of view of the tile adhesion, and therefore of resistance and duration of the installation.

These and other advantages are evident from the following detailed description of a preferred embodiment with the aid of the enclosed schematic drawings whose details are not to be intended as limiting but only exemplary.

CONTENT OF THE DRAWINGS

Figure 3A:
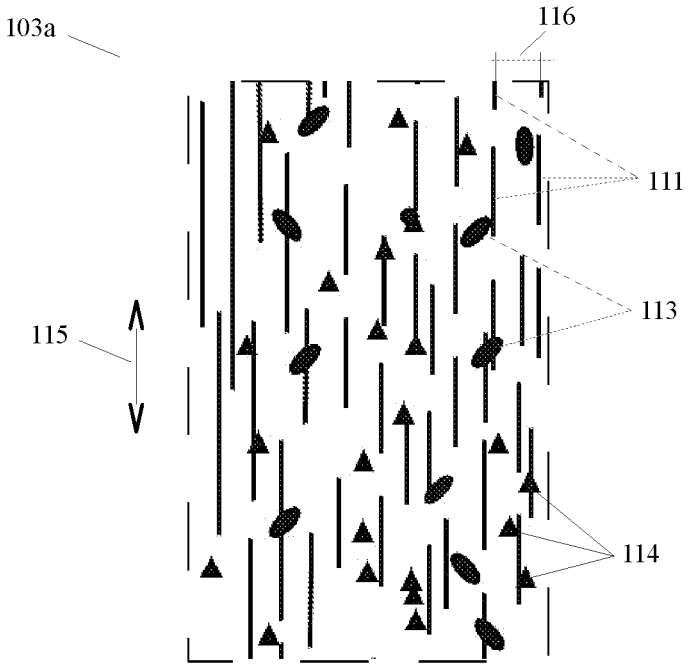
Figure 3B:
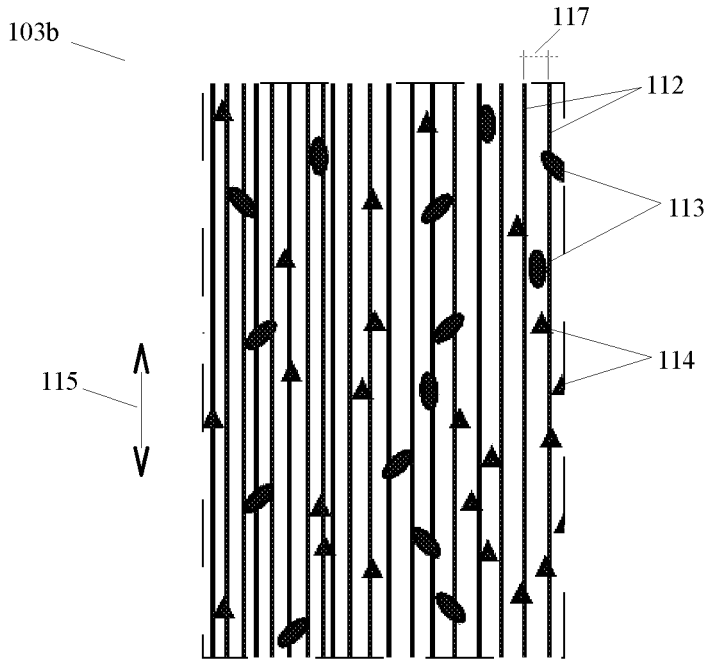

FIGS. 3*a* and 3*b* schematically represent the superficial scratching of the coating, enlarged under the microscope, with non-through incisions shaped like scratches which are rectilinear and parallel with other non-through incisions shaped like circular and/or triangular ellipsoidal notches. In a first different embodiment, as in FIG. 3*a*, said rectilinear scratches are discontinuous; in a second embodiment, as in FIG. 3*b*, they are continuous and closer to each other being obtained with a different productive method.

Figure 1:
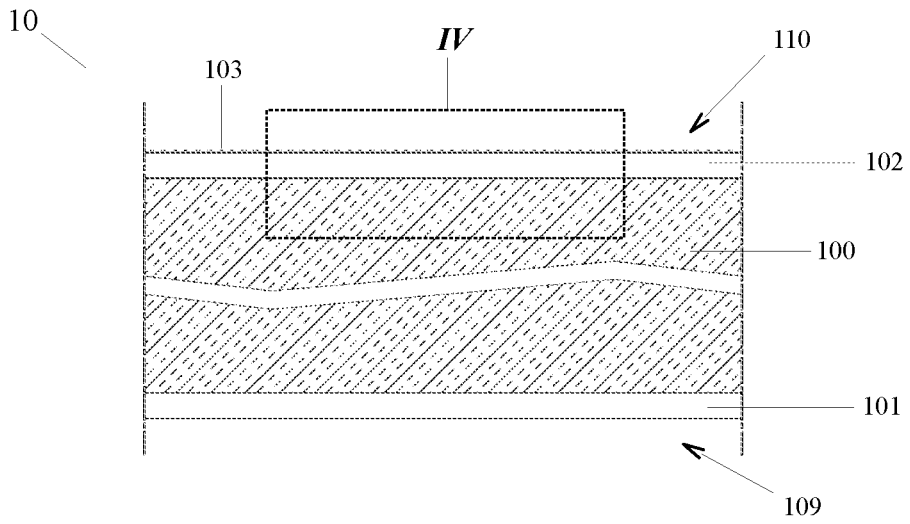
FIG. 1 represents the insulating panel for construction, which is the subject matter of the present invention, in a detailed schematic section not to scale: the dashed rectangle (IV) defines a coating portion which is enlarged in following figures.
Figure 2:
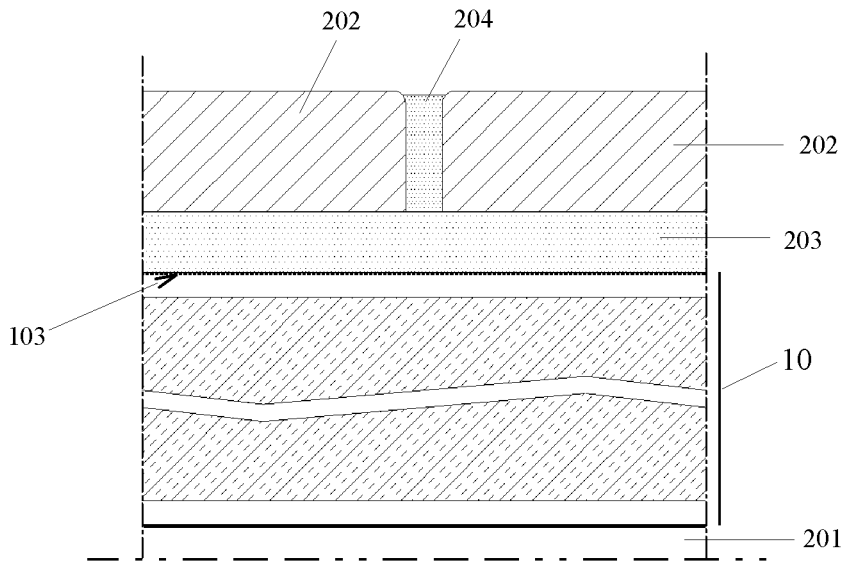
FIG. 2 represents the same panel of the previous figure, mounted in adhesion on a load-bearing structure and with a layer of ceramic tiles, directly glued on the scratched surface of the coating, in a detailed schematic section not to scale.
Figure 4A:
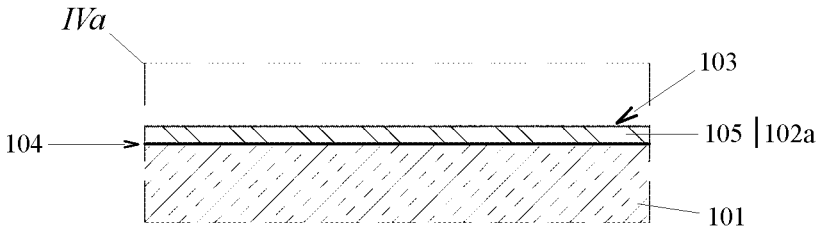
Figure 4B:
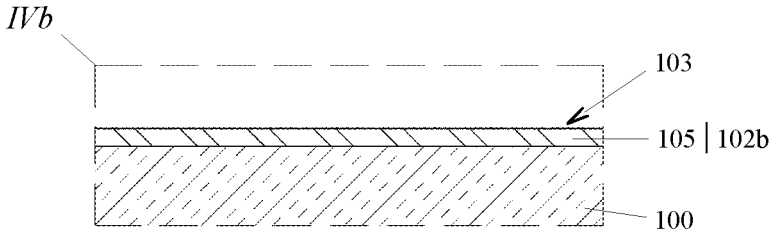
Figure 4C:
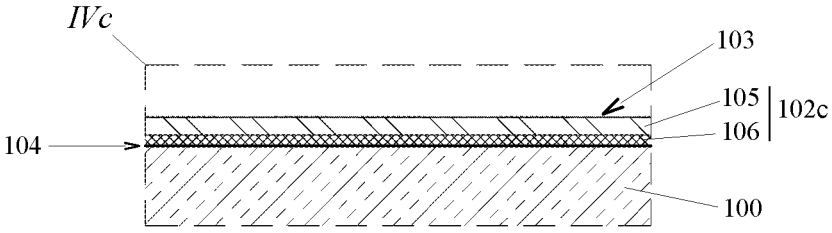

FIGS. 4*a*, 4*b*, and 4*c* are enlargements of the sectioned coating, according to the dashed rectangle in FIG. 1 (IV), related to three variants (IVa, IVb, IVc).

PRACTICAL REALIZATION OF THE SUBJECT MATTER OF THE INVENTION

Also with reference to the figures (FIGS. 1-4), an insulating panel for construction (10) is proposed of the insulating and self-supporting type, suitable for contextually performing various functions: it is a lightweight non-conductive panel, provided with a high rigidity and resistance to bending, which acts as flat constructive element suitable for making walls, infill walls, floors or subfloors, and which is also suitable for protection against vapor and damp. In particular, the present invention proposes an advantageous multi-layer panel which is suitable for installations in damp environments such as bathrooms or saunas, which has at least one surface layer provided with a particular scratching which considerably increases said tensile resistance perpendicularly to the plane, also called resistance to tearing or pull-out: this scratching is obtained with a superficial mechanical treatment which is inexpensive, and easy to be industrially obtained, making the laying of ceramic tiles directly glued thereon more effective, safer and more durable, according to the aims described above.

It is noted that the proposed insulating panel (10) has no layers of cement-based materials, yet it properly supports the laying of tiles directly glued on its outer surface by means of glues or cement mortars commonly used, without the need for interposing a primer layer, a fabric or a net for grab. Therefore, it allows to lay thin tiles of the ceramic or cement type, but it is also suitable for the grab of cement-based plasters or other similar finishing, which are directly applied, ensuring an excellent adhesion with high resistance to tearing both in correspondence with the superficial grab area and between the internal layers. Said insulating panel (10) considerably facilitates the completion works in indoor environments of buildings, and it is particularly suitable for damp environments with vapor and/or water such as bathrooms, saunas, laundry rooms, or kitchens. For example, it (10) allows a single operator to rapidly and inexpensively build a whole bathroom coated with ceramic tiles and provided with articulated volumes such as the shower space and wall niches. For example, in a typical installation in a damp environment with the aims of coating and waterproofing (FIG. 2), said panel (10) can be fixed in adhesion to a load-bearing structure (201) such as a masonry or a floor slab, or to a partition of plasterboard or wood, or to any other structure, and on its front face (102, 103) a layer of tiles (202) can be directly glued by means of an adhesive layer (203) of a common glue or cement mortar with the conventional grout lines (204) of tile finishing. Such a solution does not need other materials or additional working.

The proposed insulating panel (10) is made up of a central layer (100) in an foamed and damp-resistant insulating material, which has a low specific weight and a high dimensional stability, such as XPS or EPS polystyrene or expanded polyurethane, and of a damp-resistant coating (101, 102) which is joined to said central layer (100) on both outer faces and namely a coating (102) on the front side (110) and a coating (101) on the back side (109), forming a symmetrical sandwich structure, wherein said coating protects, hardens and increases the resistance to the passage of vapor and/or the impermeability of the panel (10). The coating (101, 102) can be in a single layer, made of one material only, or multi-layer made of different materials as described hereinafter. When the coating is multi-layer, the single layers can be coupled by means of thermo-adhesion or gluing for example with a two-component polyurethane glue. Said coating (101, 102) can be thermo-adhered or glued to said central layer (100), for example by means of a glue layer (104), in a two-component polyurethane adhesive or an epoxy glue.

Said central layer (100) has a constant thickness between 4 mm and 200 mm, with a density ranging between about 15 and 50 kg/m$^3$, each coating (101, 102), has instead a constant thickness greater than 0.1 mm; in the preferred embodiment it is provided that said central layer has a constant thickness between 6 mm and 50 mm and a density of about 30 kg/m$^3$ with a tolerance of +/−10 kg/m$^3$, while each coating has a thickness equal to 0.2 mm with a tolerance of +/−1 mm. A finished insulating panel (10) (FIGS. 1, 2) has, therefore, an overall thickness between about 6.2 and 52 mm; greater or lower values are however suitable for the proposed panel depending on a specific application.

The coating provided by the invention (101, 102, 102*a*, 102*b*) has a high resistance to the passage of vapor and a high density: in particular, at least one coating (102) has the outer surface scratched (103) namely provided with various non-through incisions, also called scratchings, which are shaped like scratches and/or grooves and/or striations and/or notches or small-sized recesses, and are uniformly distributed on the whole outer surface of the coating. It is clarified that said incisions or scratchings are essentially deformations and/or removals of minimum portions of material and are obtained by means of superficial mechanical abrasion, acting on the coating from the exterior as described hereinafter. Therefore, in order to ensure the impermeability of the coating, such incisions or scratchings have a depth smaller than the thickness of the material where they are made. In particular, said surface is scratched (103) so as to considerably increase the grab of glues or cement mortars for tiles and plasters, providing the panel with a resistance to tearing or pull-out which is always equal to or higher than 0.5 $N/mm^2$ according to said EN 1348 regulation, ensuring a high reliability also in vertical installations and in damp environments. In particular, as a clarification, this resistance value, also cited in the claims, is typical of an insulating panel (10) made such as provided by the present invention (100, 101, 102, 102*a*-102*c*, 103) and it is intended to be referred to the expressly indicated regulation and to the measuring method above described.

It is noted that said superficial abrasion treatment or scratching (103) is always performed on the coating (102) placed on the side contacting the cement glue (203) which is used to anchor the tile (202), conventionally called front side (110). This solution is advantageous, for example, when the panel (10) is mechanically fixed to a metal frame or to a wood framework. Furthermore, the panel (10) can be provided with a scratched surface (103) on both sides (109, 110); this solution is advantageous when it is fixed in adhesion to an existing wall by means of gluing on the back side (109).

More in technical detail, the coating (101, 102, 102*a*, 102*c*) (FIG. 4*a*, 4*b*) consists of a plastic plate (105) of a thickness equal to 0.2 mm with a tolerance of +/−0.1 mm, a density equal to 1.1 $kg/dm^3$ with a tolerance of +/−0.2 kg/dm, and a Rockwell hardness D equal to 75 with a tolerance of +/−20. This plate has the combined function of increasing the resistance to the passage of vapor and the panel impermeability, protecting from impacts, and acting as structural reinforcement, and also allowing a suitable making of said scratched surface (103), with non-through and well controlled incisions. It is made of a plastic material of the virgin or recycled polyolefin type, or in polyester or polystyrene, both in the generic version and in version with high resistance to impact: for example, the material called by the acronym HDPE, or PP, or also GPPS or HIPS or mixtures thereof is suitable. In a preferred embodiment (102*a*, FIG. 4*a*), said plastic plate (105) is joined to the central layer (100) by means of a glue layer (104); alternatively (102*b*), where the material compatibility allows it, it (105) is joined by means of thermo-adhesion (FIG. 4*b*).

In a different embodiment (FIG. 4*c*) intended to facilitate the adhesion of said plastic plate (105) to the central layer (100), it is provided to interpose between them a permeable layer of a non-woven fabric (106) or called by the acronym TNT, made of a plastic material alternatively selected among: polypropylene, polyamide, or polyester. Said TNT is coupled to the plastic plate like a multi-layer coating (102*c*, 105, 106), such as for example pre-coupled, being joined to each other by thermo-adhesion or gluing: afterwards, said multi-layer coating is joined (101, 102) to the central layer (100) with a glue layer (104). Preferentially, said non-woven fabric (106) undergoes a treatment for resisting in alkaline environments, such as to increase the safety and the global duration of an installation.

The insulating panel for construction (10, 103) described above is suitable for the continuous industrial production with high production volumes, according to a productive process comprising the following operative phases (F1-F9):

F1) a first phase for making a foamed plate suitable for forming said central layer (100) of the panel, alternatively obtained by means of extrusion and expansion if it is made of XPS polystyrene, or obtained by means of expansion if it is made of EPS polystyrene or polyurethane;

F2) a second phase for curing said foamed plate;

F3) a third phase for cutting in thinner plates, according to the needs;

F4) a fourth phase for preparing the coating (101, 102), with possible pre-coupling of multiple layers where it is a multi-layer coating;

F5) a fifth abrasion phase, by brushing or sanding, simultaneous with the previous phase (F4), where the outer surface of at least one coating (102) is mechanically machined so as to make it scratched (103), with various non-through incisions which are uniformly distributed;

F6) a sixth phase for joining said coating (101, 102) on said foamed plate (100), alternatively by means of an interposed glue layer (104) or by means of thermo-adhesion, wherein the coating is symmetrically applied on both sides of the plate like a sandwich panel;

F7) a seventh finishing phase, where said plate with coating is cut to size in finished panels by means of a cutting and squaring device at 90°, such as for example a pantograph;

F8) an eighth abrasion phase, by brushing or sanding, simultaneous with the previous phase (F7), where the outer surface of at least one coating (102) is mechanically machined so as to make it scratched (103), with various non-through incisions which are uniformly distributed;

F9) a ninth phase for packing and moving said grouped panels, being for example packed in pallets for the transport to the client.

In particular, said fifth phase (F5) and said eighth phase (F8) can be alternatively performed, namely only one of said phases, or both; as a clarification, for the aims of the invention, at least one of them must be however performed on the outer surface of at least one coating (102) so as to always provide the panel (10) with a scratched surface (103) which improves the adhesion and the grab of the cement mortar.

More in technical detail of the method and the equipment provided to obtain said scratched surface (103), in the preferred and non-limiting embodiment of the invention, simultaneously to said phase for preparation of the coating (102, F4) its most outer surface is passed through a station for abrasion (F5) including brushes with metallic teeth—thin and rectilinear or bent like a hook—which are mounted on a roller rotating in the opposite direction compared to the direction of the coating (102, 115). This working allows to rapidly perform a scratching (103) which is uniformly distributed on the whole surface with several non-through incisions shaped like scratches which are rectilinear and parallel to the direction (111, 112, 115) of the machine, similar to thin striations. Said roller and said brushes are advantageously adjustable so that, by varying the dimension of the single metallic tooth and/or the pitch (116, 117) between two teeth and/or the distance or pressure on the surface and/or the tilt with respect to the plane and/or the orientation on the plane, it is possible to obtain a variable conformation of said scratching (103), according to a desired effect (111-117), which can be more effective for the grab of a specific cement mortar for tiles and/or more suitable for the nature and consistency of the surface layer.

As a clarification, the abrasion provided by the invention is a mechanical machining from the outside which can be performed in two different phases of the productive process, so as to obtain a greater production versatility and/or combined and/or varied scratching effects (103). Indeed, the abrasion can be performed simultaneously to the phase for making the coating (102, F4-F5) with the operations and the equipment described above, or it could be subsequently performed (F8), on the finished panel: alternatively, it is performed in both phases (F5 and F8), so as to sum the effects in order to achieve a more complex and multiform and/or more effective scratching for adhesion.

It is indeed possible to obtain the same superficial scratching effect described above (102, 103, 111, 112) by letting the finished and assembled panel, being already joined to the coating (100, 101, 102) and trimmed to size on the four sides, pass through a grinding station in which there are pushing rollers covered with abrasive paper, preferably having different grain sizes. Also in this case, the superficial effect may vary according to the executive modes: in particular, the depth and the pitch (116, 117) of the striation-like incisions depend on the grain size of the used abrasive paper. For example, said grinding station can be a roller calibrating machine for the furnishing industry, where said rollers are adjustable and are covered with abrasive paper having a FEPA grain number between P40 and P120: in such a case, said calibrating machine is also equipped with an instantaneous dust suction system in order to prevent dust from obstructing localized removals and/or micro-scratchings made by the abrasive paper. Also in this second abrasion method, the sanding rollers can be advantageously adjustable so that by varying the type or grain of the abrasive paper and/or by varying the distance or pressure on the surface and/or the tilt with respect to the plane and/or the orientation on the plane, it is possible to obtain a variable conformation of said scratching effect (103), according to a desired effect.

By way of example only, the figures (FIGS. 3*a*, 3*b*) schematically represent two variants of scratching (103*a*, 103*b*) which can be obtained with the process and the equipment described above, referred to a superficial widely enlarged portion. In particular, in the first variant (103*a*) said rectilinear scratches are discontinuous (111, 116) and can be preferably obtained by means of said brushes with thin metallic teeth. Additionally, for a combined effect, there are also ellipsoidal (113) and triangular (114) notches which can be obtained with the same device where other brushes have metallic teeth of a different diameter, bent and variously oriented depending on the desired incision, also by tilting the rotation axis if the desired effect requires it. In the second variant (103*b*), instead, said rectilinear scratches are continuous (112, 117) and can be preferably obtained by means of said grinding station with pushing rollers coated with abrasive papers: in addition, for a combined effect, also ellipsoidal (113) and triangular (114) notches can be obtained as described above. In such case it is thus preferable to preliminarily make the notches on the coating, and then to make the striation in the form of continuous scratches on the already assembled panel. It has been experimentally found that the different scratching effects (103, 111-117) described above can be obtained in both dedicated productive phases (F5, F8) by means of the described equipment, with said brushes or with abrasive paper, providing the manufacturer with industrial advantages and/or advantages in terms of results of the finished product.

In a further different embodiment not represented in the figures, suitable for increasing the resistance of the panel (10) to high temperatures and/or fire, the glue layer (104) comprises expanding graphite and/or sodium silicate and/or ammonium polyphosphate and/or triethyl phosphate called by the acronym TEP and/or zinc borate, said components being considered individually or in combination with each other, in a global concentration between 1% and 20% on the total weight. Alternatively, or in addition to this solution, in order to further increase the resistance to fire and avoid the collapsing in case of fire, it is provided to add a small net of fiberglass acting as reinforcement in said glue layer (104). To this aim, a small net with a mesh opening between a minimum of 5 mm by 5 mm and a maximum of 20 mm by 20 mm is suitable. And still, alternatively or additionally to these solutions, in order to obtain a greater increase, said central layer (100) and/or said plastic plate (105) is expected to be made in a polymer also comprising expanding graphite and/or sodium silicate and/or trichloro propyl phosphate called by the acronym TCPP and/or ammonium polyphosphate and/or brominated compounds, said components being considered individually or in combination with each other in a global concentration between 1% and 20% on the total weight of said layer (100) for increasing the fire resistance of the panel (10). It is noted that such an increase of the fire resistance can be industrially obtained in an easy way and with a limited cost increase, only by adding the above-mentioned ingredients to the composition of said insulating (100) and/or adhesive (104) and/or plastic (105) material, without any particular processing.

Moreover, it has been found that in practical use the insulating panel (10) proposed in the present invention is contextually provided with a high resistance to bending and damp, it is very lightweight, self-supporting and easy to transport, and it can be processed in the construction site like any panel for non-conduction, safely and without releasing dusts. In particular, the outer scratched surface (103) ensures an improved adhesion in order to more effectively support the laying of tiles or plasters, compared to similar multilayer solutions without cement, by using common glues or cement mortars for tiles and without adding any interposed film, fabric, net or primer to allow the grab.

Finally, it has been experimentally found that said superficial scratching (103), mechanically made as provided by the present invention, allows the proposed insulating panel (10) to obtain improved values in a test of tensile strength perpendicular to the plane, also called resistance to tearing or pull-out; said test has been performed on a packet including the proposed panel (10) in the different variants as described above, and one ceramic tile (202, 203) glued by means of a common cement mortar, obtaining values always higher than 0.5 n/mmq according to said EN 1348 regulation. In particular, on said packet subjected to traction, the breaking interface is in the central layer (100) namely inside the foamed insulating material; this occurs due to the fact that all the adhesion interfaces of the panel between the layers and on the surface of grab are so effective and resistant that the weak spot of the stratification corresponds to the foam material having a lower density and a structure of cellular type.

NOMENCLATURE (10) rigid panel for construction, according to the present invention;

(100) central layer in a foamed insulating material, such as extruded and expanded polystyrene or extruded polystyrene called by the acronym XPS, or expanded polyurethane called by the acronym EPS, or expanded polyurethane;

(101, 102) external coating, respectively placed on the back side or structure-side (101) and on the front side or finishing-side (102), wherein at least the coating on said finishing-side has the outer surface scratched according to the present invention;

(102*a*-102*c*) different embodiments of the coating;

(103) outer scratched surface;

(103*a*, 103*b*) alternative effects of superficial scratching;

(104) glue layer, for example a two-component polyurethane adhesive;
(105) plastic plate;
(106) non-woven fabric;
(107) mineral layer;
(108) supporting layer of the mineral layer or carrier;
(109) back side or structure-side, for example facing a masonry;
(110) front side or finishing-side, which can be coated with a layer of tiles.
(111) discontinuous and rectilinear scratching, like a non-through incision parallel to the other discontinuous scratchings;
(112) continuous and rectilinear scratching, like a non-through incision parallel to the other continuous scratchings;
(113) ellipsoidal notch, like a non-through incision with ellipsoidal or circular notch;
(114) triangular notch, like a non-through incision with triangular notch;
(115) direction of the parallel scratches;
(116) center distance between parallel and discontinuous scratches;
(117) center distance between parallel and continuous scratches;
(201) load-bearing structure, for example a masonry or a floor slab, or a partition in plasterboard or wood;
(202) tile, in a ceramic material with thin thickness or equivalent;
(203) adhesive layer for laying, in a glue or a cement mortar for tiles;
(204) finishing grout line between tiles.

The invention claimed is:

1. An insulating panel for use in construction, the insulating panel comprising:

a central layer formed of an insulating foam and water-resistant material having a low specific weight and high dimensional stability, said central layer having a front side and a back side;

a first water-resistant coating joined to the front side of said central layer; and a second water-resistant coating joined to the back side of said central layer, each of said first water-resistant coating and said second water-resistant coating being adhered by a glue layer or a thermo-adhesive material to the respective front side and the back side of said central layer, wherein each of said first water-resistant coating and said second water-resistant coating is a plastic sheet having a thickness of 0.2 millimeters with a tolerance of 0.1 millimeters and a density of 1.1 kilograms per cubic decimeter with a tolerance of 0.2 kilograms per cubic decimeter and a hardness of D75 with a tolerance of 20, wherein said first water-resistant coating has an exterior surface that is scratched such that the insulating panel has a tear resistance of no less than 0.5 Newtons per square millimeter.

2. The insulating panel of claim 1, further comprising:

a nonwoven fabric layer interposed between the plastic sheet and said central layer and joined to said central layer by the glue layer.

3. The insulating panel of claim 2, wherein said nonwoven fabric layer is treated so as to be alkaline resistant, said nonwoven fabric layer being of a material selected from the group consisting of polypropylene, polyamide and polyester.

4. The insulating panel of claim 2, wherein the glue layer is selected from the group consisting of a two-component polyurethane adhesive and an epoxy glue.

5. The insulating panel of claim 4, wherein the glue layer has a component selected from the group consisting of an expandable graphite, a sodium silicate, an ammonium polyphosphate, a triethyl phosphate, a zinc borate and mixtures thereof, the component having concentration of between 1% and 20% of a total weight of the glue layer.

6. The insulating panel of claim 4, wherein the glue layer has a net of fiberglass therein, the net having a mesh opening of a minimum of 5 millimeters by 5 millimeters and a maximum of 20 millimeters by 20 millimeters.

7. The insulating panel of claim 1, further comprising:

a multi-layer coating coupling the plastic sheet to said central layer, wherein layers of said multi-layer coating are coupled to each other by the thermo-adhesive material or by glue layer.

8. The insulating panel of claim 7, wherein the multi-layer coating is pre-coupled.

9. The insulating panel of claim 1, wherein the plastic sheet is of a material selected from the group consisting of high-density polyethylene, polypropylene, high-impact polystyrene and mixtures thereof.

10. The insulating panel of claim 1, wherein the scratch on the exterior surface of said first water-resistant coating is mechanically abraded into incisions uniformly distributed over an entirety of the exterior surface of said first water-resistant coating, each of the incisions having a depth less than a thickness of said first water-resistant coating.

11. The insulating panel of claim 1, wherein said central layer has a constant thickness of between 4 millimeters and 200 millimeters and has a density of between 15 kilograms per cubic meter and 50 kilograms per cubic meter.

12. The insulating panel of claim 1, wherein said central layer has a constant thickness of between 6 millimeters and 50 millimeters and has a density of 30 kilograms per cubic meter with a tolerance of 10 kilograms per cubic meter.

13. The insulating panel of claim 1, wherein said central layer is formed of a polymer selected from the group consisting of an expandable graphite, a sodium silicate, a trichloro propyl phosphate, and a brominated compound.

14. The insulating panel of claim 1, wherein the plastic sheet is formed of a polymer selected from the group consisting of an expanding graphite, a sodium silicate, a trichloro propyl phosphate, an ammonium polyphosphate, a brominated polymer and mixtures thereof.

15. A process for forming an insulating panel, the process comprising:

making a foamed sheet as a central layer of the insulating panel;

curing the foamed sheet into a plurality of thinner sheets;

preparing a coating;

abrading the coating by mechanically cutting an outer surface of the coating so as to scratch the coating with uniformly distributed non-through incisions;

joining the abraded coating onto the foamed sheet with a glue layer interposed between the abraded coating and the foamed sheet or with a thermal adhesive, the coating being symmetrically applied to opposite sides of the foamed sheet;

cutting the foamed sheet with the coating to a desired size into finished panels; and packing and moving the finished panels for transport, wherein the step of abrading is carried out by sanding or brushing.

16. The process of claim 15, wherein the abrading is carried out by brushing with at least one flat passage on a roller conveyor, the roller conveyor having at least one roll having metallic brushes with thin wires having folded ends, the at least one roller being height adjustable or tiltable.

17. The process of claim 15, wherein the abrading is by sanding by at least one flat passage through a grinding station, the grinding station having pushing rollers covered with an abrasive paper, the pushing rollers being height adjustable or tiltable.

18. The process of claim 15, wherein the grinding station has a calibrating machine with adjustable roller, the adjustable roller being covered with the abrasive paper having a FEPA grain number of between P40 and P120, the calibrating machine having a dust suction system therein.

* * * * *